United States Patent [19]

Martel et al.

[11] 4,137,871

[45] Feb. 6, 1979

[54] FUEL SUPPLY DEVICE FOR INTERNAL COMBUSTION ENGINE

[75] Inventors: Bernard G. M. Martel, Bagneux; Philippe G. S. Wallerand, Le Pecq; Daniel L. Eygret, L'Etang-la-Ville, all of France

[73] Assignee: Societe Industrielle de Brevets et d'Etudes S.I.B.E., France

[21] Appl. No.: 740,651

[22] Filed: Nov. 10, 1976

[30] Foreign Application Priority Data

Nov. 20, 1975 [FR] France ..... 75 35535

[51] Int. Cl.[2] ..... F02B 3/02

[52] U.S. Cl. ..... 123/32 EG

[58] Field of Search ..... 123/32 EG, 32 EF, 32 EJ, 123/32 EA, 140 MP, 119 R, 139 AW

[56] References Cited

U.S. PATENT DOCUMENTS

| | | | |
|---|---|---|---|
| 2,980,090 | 4/1961 | Sutton et al. | 123/119 R |
| 3,712,275 | 1/1973 | Jackson | 123/32 EA |
| 3,867,913 | 2/1975 | Pierlot | 123/32 EA |
| 3,967,608 | 7/1976 | Mennesson | 123/32 EA |
| 4,034,721 | 7/1977 | Lenzi et al. | 123/140 MP |

*Primary Examiner*—Samuel Feinberg

*Attorney, Agent, or Firm*—Stevens, Davis, Miller & Mosher

[57] ABSTRACT

A fuel injection device comprises an air valve located upstream of an operator actuated throttle in the air intake passage. The air valve is actuated by airflow through the passage and opens in proportion to the increase in the flow rate of air. Fuel under pressure is delivered to the air passage through an electrically energized injector valve. A metering system which is sensitive to the position of the air valve supplies the valve with repetitive electrical pulses during normal operation of the engine. During cranking, the metering system delivers a continuous energization signal to the valve for maintaining it permanently open. The pressure of the fuel delivered to the valve is substantially decreased during cranking, i.e. as long as a continuous energization signal is delivered to the injector valve.

9 Claims, 3 Drawing Figures

34
35
÷2
36
÷2
37
15
38
39
42
43
44
12
40
41
T1
46
T2
47
48
49
50
51
52
53
45
32
RAZ

FUEL SUPPLY DEVICE FOR INTERNAL COMBUSTION ENGINE

The invention relates to fuel supply devices for internal combustion engines, of the type having auxiliary throttle means located upstream of operator actuated main throttle means in an air intake passage, the auxiliary means being actuated by airflow through a passage so that the position of said auxiliary throttle means is representative of the airflow, a fuel circuit receiving fuel under pressure from a source and opening into said passage through at least one electrically controlled injector valve, and a fuel metering system which is responsive to the position of the auxiliary throttle means and which, during operation, supplies the electrically controlled injector valve with electrical energization pulses whose time width as compared with the pulse frequency is varied in dependance with the position of the auxiliary throttle means.

Devices of that kind are known in which means driven continuously in rotation, typically—though not necessarily — by the engine itself trigger the electric energization pulses. Then the repetition period of the pulses is equal to the period of rotation of the means. The adjustment of the fraction of the revolution of the means during which the valve is energized determines the total time during which the valve is opened within a given time interval, and consequently the amount of fuel injected into the intake circuit during the time interval.

The fuel source generally is associated with means which automatically adjust the valve supply pressure in proportion to the depression in that portion of the intake manifold which is located between the two throttle means.

Supply devices of this kind are for instance disclosed in French Pat. Nos. 1 546 748, 1 597 816, 2 032 021, 2 041 532 and 2 146 642.

In most existing electronically-controlled fuel injection devices, a supplementary cold-start injector is provided and very finely atomises fuel under pressure into the intake manifold. This construction necessitates an additional injector and has the disadvantage of wetting the walls of the intake manifold, which is unfavourable particularly at very low temperatures.

In another prior art device (French Pat. No. 2 163 205) the same injectors are used during normal operation and during cranking. The time duration of each injection is increased during cranking. That time increase is frequently not sufficient for satisfactory operation.

It is an object of the invention to provide an improved fuel supply device of the previously-defined kind. According to the invention, there is provided a device of the above defined type wherein the metering system has means responsive to starting conditions for delivering a continuous energization signal to the injector valve from the time when an engine starter motor is energized until the time when the engine reaches a predetermined running speed.

Timing means may be provided to limit the duration of the continuous signal, starting from the triggering of the starter, to a value depending on the engine temperature.

The device may further comprise pressure reducing means responsive to said continuous control signal for maintaining the pressure of the fuel delivered to the valve at a value which is substantially lower than the pressure during operation of the engine when the engine is self operative.

Advantageously, the means are such as to maintain the fuel at a pressure directly dependent on the depression in the intake passage between the throttle means after cranking (e.g. those described in French Pat. No. 1 546 748). Then, the invention takes advantage of the fact that the regulator automatically maintains the fuel at a low pressure during engine starting (since the depression between the throttle means is very low). However, use can be made of other devices for reducing the pressure as long as the injection valve is permanently open.

The invention will be better understood from the following description of a fuel supply device constituting an embodiment thereof and given by way of non limitative example. The description refers to the accompanying drawings, in which.

Figure 1:
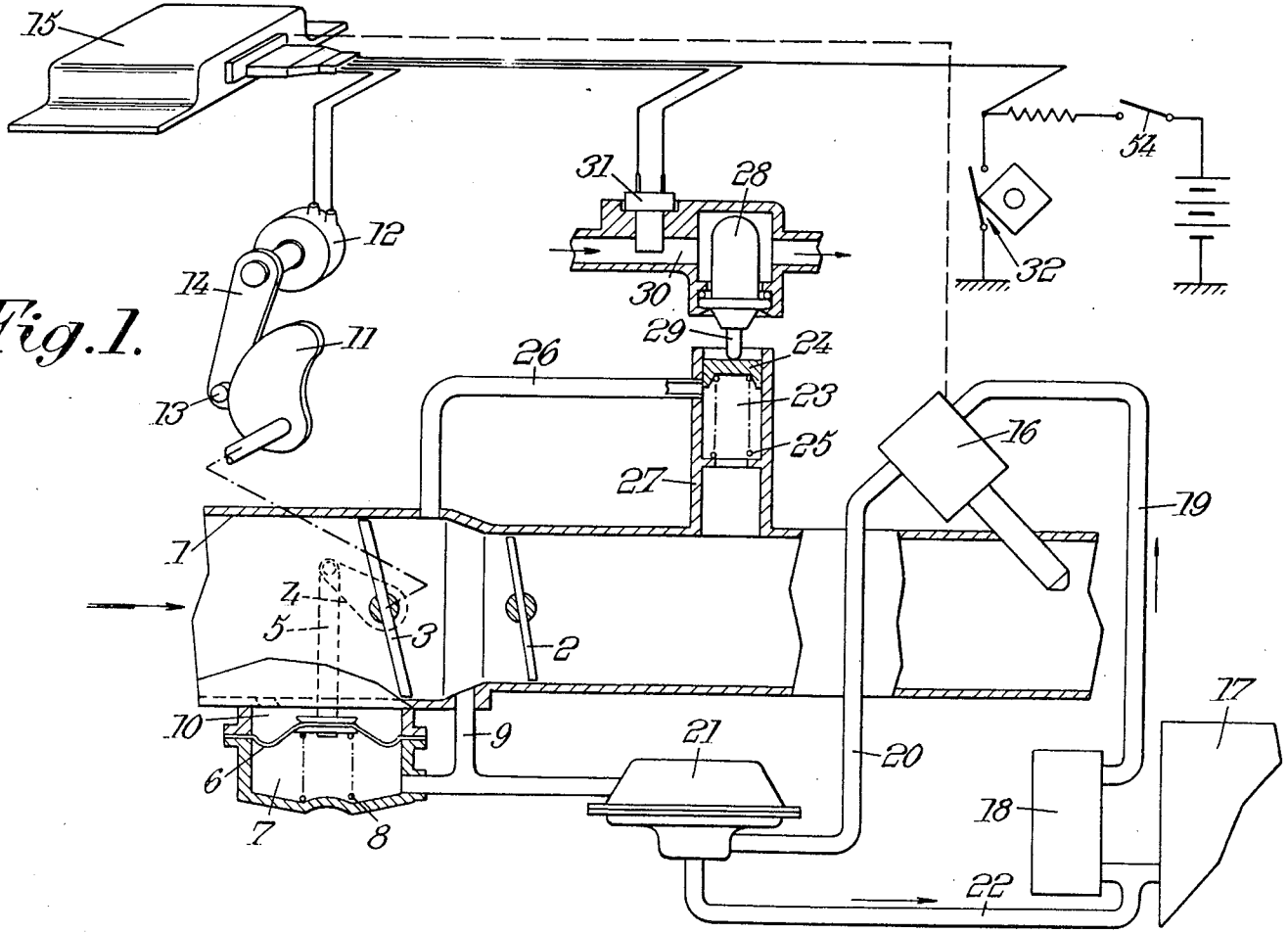
FIG. 1 is a diagram showing the general arrangement of the device.

Referring to FIG. 1, the fuel supply has a general structure similar to that of the devices described in the aforementioned patents, inter alia in French Pat. No. 2 146 642, to which reference may be made. Consequently, the non-modified parts of the device will be only briefly described.

The device comprises driver actuated main throttle means 2 and auxiliary throttle means 3 disposed upstream of means 2 in an air-intake passage 1, and cooperating therewith to bound a chamber. The auxiliary throttle means 3, consisting of an air valve, is associated with air motor means which automatically and progressively open it when the flow rate of air in pipe 1 increases. The motor means shown comprise a deformable diaphragm 6 separating a cavity 10 at atmospheric pressure from a cavity 7 connected to the chamber by a duct 9, diaphragm 6 being subjected to the return action of a spring 8. Diaphragm 6 is connected to air valve 3 by a rod 5 and a lever 4 so that the depression in cavity 7 tends to open the throttle means or air valve 3.

Air valve 3, the position of which is representative of the flow rate of air in intake passage 1, drives a rotary cam 11 on which roller 13 of the slide 14 of a potentiometer 12 bears. The resistance of potentiometer 12 constitutes an input electric signal of the metering system which controls the time during which an injector valve 16 is open. Valve 16 is supplied with fuel under pressure from a fuel tank 17 by a pump 18 having a delivery pipe 19 connected by a duct 20 to a fuel pressure regulator 21 connected by a duct 22 to the inlet of pump 18. Regulator 21 is also connected to the chamber of air intake passage 1 between throttle means 2 and 3, and adjusts the pressure of the fuel in ducts 19 and 20 to a value substantially proportional to the depression in the chamber.

The fuel supply device further comprises a cold-start system having an additional air circuit. The additional circuit comprises a chamber 23 permanently connected by a duct 27 to the air intake passage downstream of the main throttle means 2 and by a duct 26 to the chamber in the air intake passage between means 2 and 3. A piston 24 is slidably received in chamber 23 so as to throttle the inlet of duct 26 to a varying extent. Piston 24 is actuated by the projecting rod 29 of a thermostatic capsule 28 subjected to the temperature of a component representative of the condition of the engine, e.g. engine cooling water flowing in a duct 30.

The fuel metering system comprises an electronic circuit 15 receiving repetitive electric signals from means which continuously rotate during operation of the engine, for instance the contact-breaker 32 of the ignition system. Circuit 15 also receives a signal representing the temperature of the engine, e.g. from a resistor 31 having a negative temperature coefficient and kept at the engine cooling-water temperature. When the engine is cranked and is driven at low speed by the starter motor, the depression in the chamber bounded by throttle means 2 and 3 is low. Consequently, pressure regulator 21 regulates the fuel pressure at a value which is likewise low, e.g. 100 millibar if the fuel pressure reaches 2,000 millibar when the engine develops its maximum power.

The fuel metering system is constructed to permanently open valve 16 during starting, thus producing continuous injection of fuel under low pressure. In the embodiment illustrated, continuous injection begins at the first engine ignition (or as soon as the starter motor is energized) and is replaced by a periodic supply as soon as either of the following conditions is filled:

The engine reaches a predetermined speed (e.g. about 250 rpm, indicating that it has properly started and is self running; or a given time interval, varying with the temperature of an engine component (e.g. the temperature of the water flowing in duct 30), has elapsed since the beginning of cranking. The purpose of this time limit is to prevent the engine from being flooded if it does not start up. The limit can be zero when the temperature of the water in duct 30 exceeds a predetermined limit.

Figure 2:
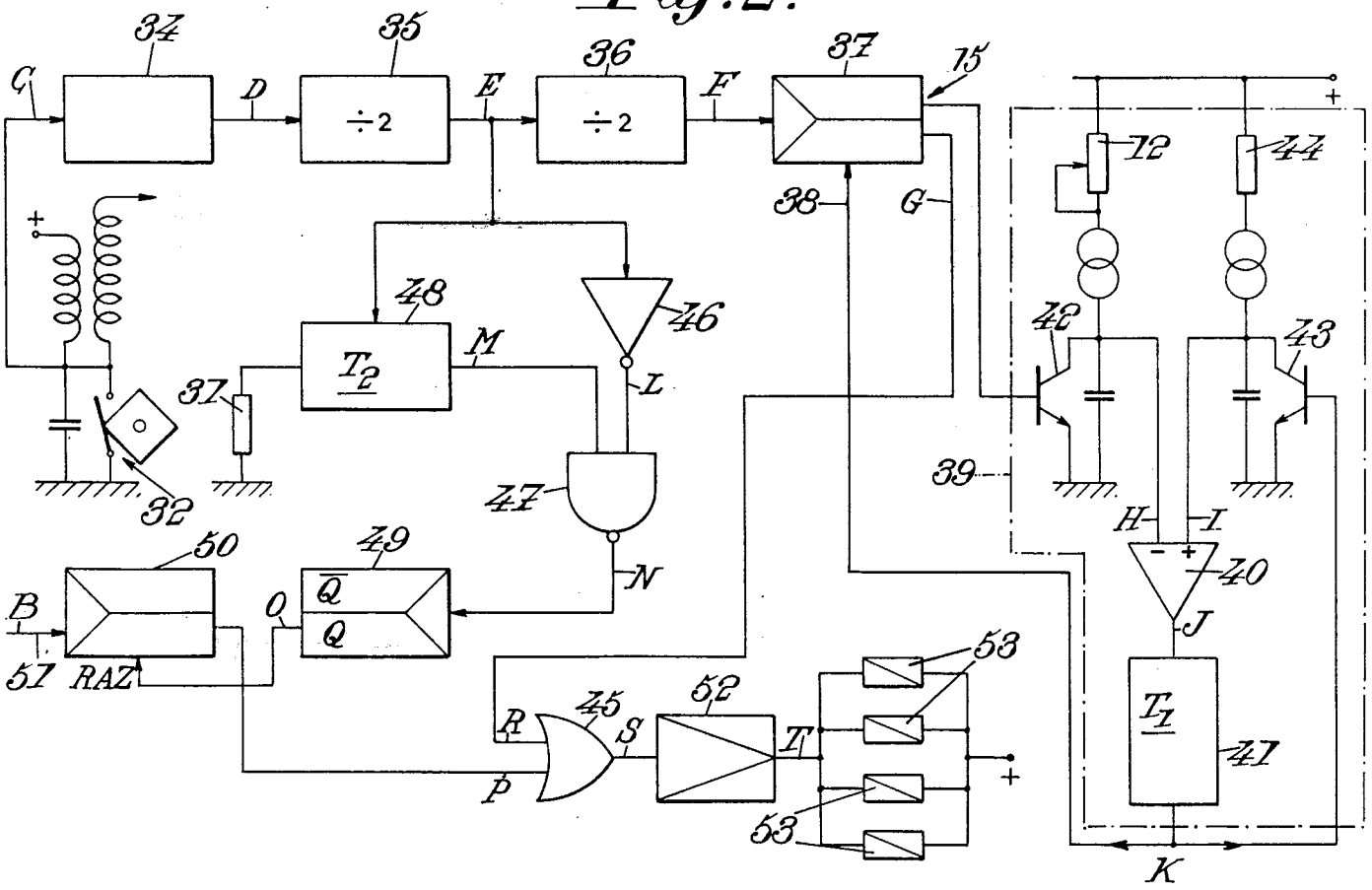
FIG. 2 is a block diagram of the electronic circuit of the fuel metering system in the device.

The circuit 15 in FIG. 2 fulfills that object. Circuit 15 comprises an input shaping circuit 34 receiving the signals supplied by contact-breaker 32 (two signals per engine revolution). Circuit 34 is followed by two dividers-by-two 35, 36 connected in cascade. The output signals of divider 36 are applied to the input of a main flip-flop 37 having a reset input 38. The output $\overline{Q}$ of flip-flop 37 is connected to circuit 39 which, at the end of cranking, determines the time duration of each opening of the valve. Circuit 39 may be of the kind disclosed in French Pat. No. 2 146 642 and comprises a comparator 40 followed by a univibrator 41 of "set" duration $T_1$. The inputs of comparator 40 are connected as follows:

the " − " input is connected to the collector of a transistor 42 operating as a triggered saw-tooth generator, the transistor base being connected to the $\overline{Q}$ output of flip-flop 37; and the " + " input is connected to the collector of a transistor 43 operating as a continuous saw-tooth generator, the base of transistor 43 being connected to the output of univibrator 41 which resets the saw-tooth to zero. The slopes of the saw teeth delivered by transistors 42, 43 are determined by respective resistors 12, 44. The value of resistor 44 can be made to depend on various engine operating parameters, or factors such as the temperature of the intaken air or cooling water.

Output $\overline{Q}$ of flip-flop 37 is connected to an input of an OR gate 45 whose other input is enabled, during cranking, by a signal supplied by a circuit comprising the following components, starting from the output of the first divider 35:

An inverter 46 whose output is connected to one of the inputs of a NAND gate 47

A univibrator 48 likewise controlled by the output of divider 35 and whose duration $T_2$ is dependent on the value of a N T C resistor 31 representing the engine temperature, the output of the univibrator being connected to the second input of NAND gate 47.

A flip-flop 49 whose input is connected to the output of gate 47; and

A second flip-flop 50 whose "high" input 51 is adapted to receive a positive voltage level as long as the engine starter is energized, the reset input of flip-flop 50 being connected to the output Q of flip-flop 49, and the Q output of flip-flop 50 being connected to the second input of OR gate 45.

The output of OR gate 45 is connected to the input of a power amplifier 52 which, when energized, actuates the electromagnet 53 of the injector valve, or valves. In FIG. 2, four valves are provided, each corresponding to an engine cylinder.

Figure 3:
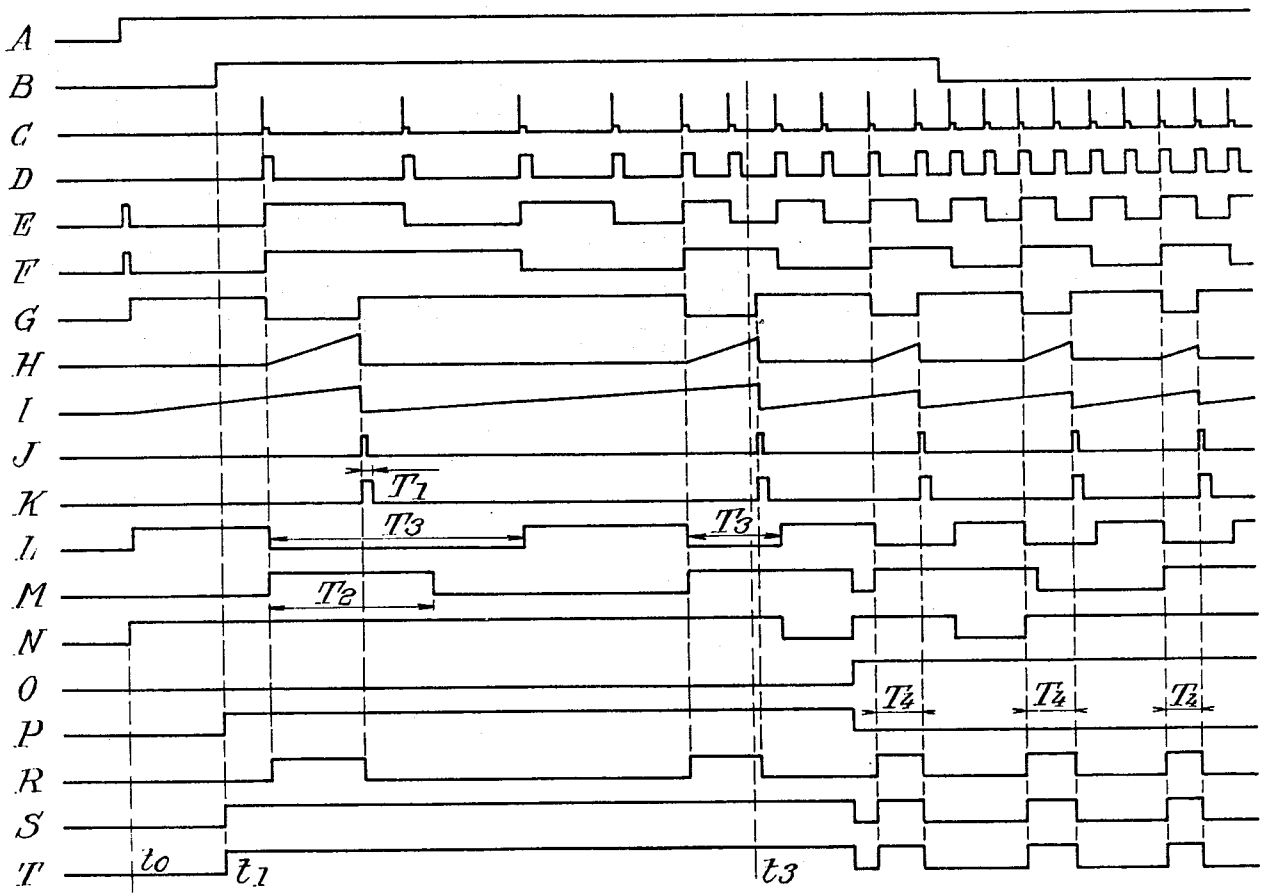
FIG. 3 is a diagram showing the signals appearing at the points of the circuit in FIG. 2 indicated by letters corresponding to the lines in FIG. 3.

The device operates as follows, during cranking of the cold engine. When the driver closes the ignition contact at instant $t_o$ (line A in FIG. 3) by closing switch 54 (FIG. 1) the electronic circuit is put in operation. When the starter motor is energized at time $t_1$, a positive voltage level (line B) is applied to the high input 51 of flip-flop 50, thus bringing flip-flop 50 into the condition where its output Q is positive (line P). The positive signal is transferred by OR gate 45 to amplifier 52 which opens the injector valves (lines S and T).

As soon as the engine is running, one input of NAND gate 47 receives a signal coming from 46 and consisting of square waves having a duration equal to a half-revolution of the engine in the case of a four-cylinder engine (line L). The other input of gate 47 receives a signal consisting of positive square waves having a duration $T_2$ and coming from univibrator 48 (line M).

The square waves are in phase opposition when triggered, and univibrator 48 is designed so that, when resistance 31 is cold, the duration $T_2$ of square waves 48 is less than the duration $T_3$ of the square waves delivered by 46.

Thus, the inputs of NAND gate 47 are permanently either in phase opposition or simultaneously "low"; thus the output of the NAND gate permanently remains "high" (line N) from instant $t_o$, and the condition of flip-flop 49 is not modified (line O). The flip-flop 50, which was brought to state Q at instant $t_1$, remains in the same state and controls continuous injection via OR gate 45 (lines P, S and T).

At instant $t_2$, the engine reaches a predetermined speed (dependent on the value of 31, i.e. on the engine temperature), at which the duration $T_3$ of the negative square waves from inverter 46 becomes shorter than the duration $T_2$ of the square waves of univibrator 48. Usually, of course, the speed threshold is not exceeded until after a greater number of operating cycles than shown, for the sake of simplicity, in FIG. 3. The inputs of NAND gate 47 are thus simultaneously "high" for a fraction of each square wave $T_2$, with the result that a "low" condition appears at the output of NAND gate 47 (line N). This condition is transferred to the input of flip-flop 49 causing it to change condition. Output Q of flip-flop 49 delivers a reset signal to flip-flop 50 (line O). Output Q of flip-flop 50 returns to zero and interrupts the continuous injection, which is replaced by normal operation as completely described in French Pat. No. 2 146 642; it is sufficient to note here that injection occurs during the time periods $T_4$ (lines R, S and T) required for the saw-teeth of transistor 43 (line I) to reach the same amplitude as the saw teeth of transistor 42 (line H) triggered at each engine revolution by one out of four pulses provided by contact-breaker 32 (lines C, D, E, F and H).

Typically, the circuit in FIG. 2 further comprises means for stopping continuous injection after a given time has elapsed from the initiation of cranking. Such means can consist of a gate disposed between the output of flip-flop 50 and the input of OR gate 45, and of a timing circuit which maintains a gate enabling signal from the time when the starter motor is initially energized until the end of the timing period. The timing circuit can comprise a thermistor subjected to the temperature of an engine component so that the delay decreases in the same proportion as the temperature increases and may fall to zero above a given temperature (e.g. approx. 50° C. in the case of a thermistor located in the engine cooling water).

Numerous modified embodiments are possible, inter alia with regard to the construction of the electronic circuit and of the pressure regulator. The regulator can as well maintain the fuel pressure at a constant value during normal operation (the pressure downstream of the auxiliary throttle means then being taken into account when determining the length of the electromagnet excitation signals) and reduce it to a precisely determined lower value as long as injection is continuous.

We claim:

1. A fuel supply device for an internal combustion engine, having auxiliary throttle means located upstream of operator actuated main throttle means in an air intake passage, the auxiliary throttle means being actuated by airflow through the passage so that the position of said auxiliary throttle means is representative of the airflow, a fuel circuit receiving fuel under pressure from a source and opening into said passage through at least one electrically controlled injector valve, and a fuel metering system which is responsive to the position of the auxiliary throttle means and which, during operation, supplies the electrically controlled injector valve with electrical energization pulses whose time width as compared with the period of repetition of the pulses is varied in dependence on the position of the auxiliary throttle means, wherein the metering system includes starting means responsive to a starting condition of the engine for delivering a continuous energization signal to the injector valve from the time when an engine starter motor is energized until the time when the engine becomes self operative and further includes pressure reducing means responsive to said continuous control signal for maintaining the pressure of the fuel delivered to the valve at a value which is substantially lower than the pressure during operation of the engine after cranking.

2. A fuel supply device according to claim 1, wherein said starting means are constructed to be inhibited when the engine temperature is higher than a predetermined value.

3. A fuel supply device according to claim 1, wherein during operation after cranking, the fuel pressure is maintained at a value which is in direct relation with the depression which prevails in the air intake passage between the auxiliary throttle means and the main throttle means.

4. A fuel supply device according to claim 1, wherein the metering system comprises timing means limiting the time duration of the continuous signal from the time when the starter is energized to a predetermined value.

5. A fuel supply device according to claim 4, wherein the predetermined value is varied in dependence on the temperature of a component of the engine.

6. A fuel supply device according to claim 1, further having means for varying the predetermined value of the speed in dependance on the temperature of a component of the engine.

7. A fuel supply device for an internal combustion engine, having auxiliary throttle means located upstream of operator actuated main throttle means in an air intake passage, the auxiliary throttle means being actuated by airflow through the passage so that the position of said auxiliary throttle means is representative of the airflow, a fuel circuit receiving fuel under pressure from a source and opening into said passage through at least one electrically controlled injector valve, and a fuel metering system which is responsive to the position of the auxiliary throttle means and which, during operation, supplies the electrically controlled injector valve with electrical energization pulses whose time width as compared with the period of repetition of the pulses is varied in dependence on the position of the auxiliary throttle means, wherein the metering system includes starting means responsive to a starting condition of the engine for delivering a continuous energization signal to the injector valve from the time when an engine starter motor is energized until the time when the engine reaches a predetermined running speed, means providing repetitive signals each triggering one said electrical pulse, said means providing repetitive signals being actuated by the engine so that the frequency of the repetitive signals is proportional to the running speed of the engine, said means of delivering a continuous signal including a circuit for maintaining said continuous energization signal comprising:

a univibrator providing a voltage square wave of predetermined duration $T_2$ in response to each said repetitive signal and a continuous injection control circuit receiving said square waves of duration $T_2$ and also receiving square waves having a duration $T_3$ equal to a predetermined fraction of said repetition period and supplying said continuous energization signal as long as $T_2$ is shorter than $T_3$.

8. A fuel supply device according to claim 7, wherein said predetermined fraction is one half.

9. A fuel supply device according to claim 7, wherein said univibrator comprises an electrical element which is sensitive to the temperature of a component of the engine and increases the duration $T_2$ when the temperature of said component increases.

* * * * *